US009365385B2

(12) United States Patent
Muxlow

(10) Patent No.: US 9,365,385 B2
(45) Date of Patent: Jun. 14, 2016

(54) FIBERBOARD SURFACE PROTECTOR

(71) Applicant: Garland Industries, Inc., Cleveland, OH (US)

(72) Inventor: Davy Paul Muxlow, Burbank, CA (US)

(73) Assignee: Garland Industries, Inc., Cleveland, OH (US)

( * ) Notice: Subject to any disclaimer, the term of this patent is extended or adjusted under 35 U.S.C. 154(b) by 49 days.

(21) Appl. No.: 14/104,469

(22) Filed: Dec. 12, 2013

(65) Prior Publication Data

US 2014/0224391 A1 Aug. 14, 2014

Related U.S. Application Data

(60) Provisional application No. 61/762,689, filed on Feb. 8, 2013.

(51) Int. Cl.

| | |
|---|---|
| ***B65H 45/12*** | (2006.01) |
| ***B65H 35/02*** | (2006.01) |
| ***B65H 37/06*** | (2006.01) |

(52) U.S. Cl.

CPC ..... *B65H 45/12* (2013.01); *B65H 35/02* (2013.01); *B65H 37/06* (2013.01); *B65H 2301/5123* (2013.01); *B65H 2701/177* (2013.01)

(58) Field of Classification Search

CPC ..... B65H 145/12; B65H 2701/177; B65H 2301/5123; B65H 45/12

USPC ..... 493/355, 396.405; 150/154; 52/3

See application file for complete search history.

(56) References Cited

U.S. PATENT DOCUMENTS

| | | | | |
|---|---|---|---|---|
| 3,443,489 | A * | 5/1969 | Watkins | B31B 1/25 493/370 |
| 4,009,820 | A * | 3/1977 | Fitzgerald | B65D 5/2038 229/122 |
| 4,291,824 | A * | 9/1981 | DeTorre | C03B 33/027 225/2 |
| 4,311,555 | A * | 1/1982 | Reinhall | B27N 3/04 162/190 |
| 4,890,874 | A * | 1/1990 | Davis | B60R 13/01 296/39.2 |
| 5,149,572 | A | 9/1992 | Gaggero et al. | |
| 5,236,753 | A | 8/1993 | Gaggero et al. | |
| 5,401,548 | A | 3/1995 | Stepanek | |
| 5,443,885 | A | 8/1995 | Wilson | |
| 6,376,582 | B1 * | 4/2002 | Iwata | B27N 1/003 264/112 |
| 6,894,249 | B1 * | 5/2005 | Hauer | C03B 33/091 219/121.67 |
| 7,045,194 | B2 | 5/2006 | Sneed | |
| 7,228,668 | B2 | 6/2007 | Gibney et al. | |
| 7,452,586 | B2 | 11/2008 | Vershum | |
| 7,752,998 | B1 | 7/2010 | Noble | |
| 7,786,028 | B2 | 8/2010 | Souther et al. | |
| 2002/0071924 | A1 | 6/2002 | Lopez-Valverde | |
| 2003/0143358 | A1 | 7/2003 | Needles | |
| 2005/0118398 | A1 * | 6/2005 | Reichwein | B32B 21/06 428/167 |

(Continued)

*Primary Examiner* — Sue A Weaver

(74) *Attorney, Agent, or Firm* — Fay Sharpe LLP

(57) ABSTRACT

A fiberboard sheet is provided comprising a surface protector with a plurality of embedded creases wherein each of the creases can be folded in order to position a portion of the fiberboard sheet horizontally and another portion of the fiberboard sheet vertically. The fiberboard surface protector provides for quick and easy folding of the fiberboard sheet, along a multitude of crease lines, to allow for simultaneous horizontal and vertical protection within a single product. The fiberboard surface protector eliminates the need for two or more separate products and extra steps in the protection process. The fiberboard surface protector creates a seamless barrier between a horizontal and a vertical junction of orthogonally adjacent surfaces.

14 Claims, 3 Drawing Sheets

(56) References Cited

U.S. PATENT DOCUMENTS

2006/0210753 A1 9/2006 Kadlec
2007/0048482 A1 3/2007 Kadlec
2007/0128961 A1* 6/2007 Camp ..... B32B 27/12 442/85
2008/0086952 A1* 4/2008 Holwick ..... E04G 21/30 52/3
2010/0319310 A1* 12/2010 Smith ..... B01D 39/163 55/527
2011/0073239 A1 3/2011 Manning et al.
2011/0139861 A1* 6/2011 Franco ..... B65B 11/004 229/103.2
2011/0173924 A1 7/2011 Ambrose, Jr. et al.
2013/0253683 A1* 9/2013 Herdt ..... B29C 53/063 700/98

* cited by examiner

FIBERBOARD SURFACE PROTECTOR

This application claims the priority benefit from U.S. Provisional Patent Application Ser. No. 61/762,689, filed Feb. 8, 2013, the disclosure of which is incorporated herein by reference.

BACKGROUND OF THE INVENTION

The present disclosure relates generally to protective coverings, and more particularly to a protective covering for protecting finished work and other surfaces during construction, moving, painting, or other activities, and a method of manufacturing the protective covering.

The process of building out an area or constructing a building occurs in many phases. During this process, a number of different types of workers are required and it may be necessary to complete the construction in steps. As a result, frequently contractors damage floors, stairs, countertops, and other finished work in the process of completing other tasks and moving in and out heavy equipment.

During the last stages of house or building construction, and after floor and countertop materials already have been installed, finish work such as painting, caulking, finish carpentry, and appliance and lighting fixture installation is typically done. This finish work can often cause significant damage to plastic laminates, linoleum, hardwood, ceramic tiles, and carpets before the building is finished, sold, or moved into. Heavy tools, caulking and paint buckets, and appliance edges are particularly damaging.

Traditionally, the only protection, if any, given to floors and countertops during the final stages of construction has been a thin fabric drop cloth or a thin plastic sheet such as the 0.002 inch thick self-adhesive plastic sheet. These help protect against paint or caulking splatters and soil on workers' feet, but do not protect against gouges, scraps, abrasion, or other damage and breakage due to impact of objects or moving of equipment/tools.

Fabric throw rugs or moving van style blankets can be used but these absorb liquids, snag and catch on appliances, and do not protect against sharp and forceful impact. Also, these covers are bulky and heavy to transport and store.

Other products are designed to protect floors or walls independently but not both at the same time with one product. These products leave the base of walls and the perimeter of the floor exposed to damage. It is to be appreciated that where separate products are used to protect the floor and the wall, the lower section of walls including the baseboards can be easily damaged on job sites. Additionally, present products do not protect from liquid spills occurring at or near the junction between the wall and floor.

In view of the current state of the art, there is a need for a floor covering that is easy to use, protects against sharp and forceful impact a floor surface and which also protects the lower section of walls including the baseboards.

SUMMARY OF THE INVENTION

The present invention is directed to a fiberboard sheet having a plurality of embedded creases, wherein each of the creases can be folded in order to position a portion of the fiberboard sheet horizontally and another portion of the fiberboard sheet vertically. The term crease used herein includes scoring or perforating the surface. The fiberboard surface protector provides for quick and easy folding of the fiberboard sheet, along a multitude of crease lines, to allow for simultaneous horizontal and vertical protection within a single product. The fiberboard surface protector eliminates the need for two or more separate products and extra steps in the protection process. The fiberboard surface protector creates a seamless barrier between a horizontal and a vertical junction of orthogonally adjacent surfaces. The material used to form a majority or the complete composition of the protective surface protector of the present invention is fiberboard. As defined herein, fiberboard is a type of engineered wood product that is made out of wood fibers. The general types of fiberboard (in order of increasing density) include particle board, medium-density fiberboard, and hardboard. Plywood is not a type of fiberboard, as it is made of thin sheets of wood, not wood fibers or particles. Cardboard is also not fiberboard since it includes a corrugated layer. The one or more creases formed in the fiberboard are designed to enable the fiberboard to be folded along the crease without causing the fiberboard to tear or separate along the crease. This invention is a significant improvement in that now fiberboard that is a very durable material can be used. In the past, the folding of fiberboard resulted in the breakage of the fiber board, thus making it undesirable for a floor protection system. Cardboard has been used in the past since it can be easily folded; however, cardboard is not as dense and durable as fiberboard of the similar thicknesses, thus did not provide for the desired floor protection in many applications. The fiberboard is generally a water resistant fiberboard; however, this is not required.

In summary, the present invention is directed to a surface protector to protect selected portions of surfaces. The surface protector can be a reusable surface protector; however, this is not required. The protector includes a sheet of foldable fiberboard material having a perimeter, a top surface and a bottom surface, and at least one crease (e.g., 1-20 creases, 2-10 creases, 2-5 creases, 3 creases, etc.). The number creases may vary slightly due to the custom needs of users. The plurality of creases are offset a distance inward from the perimeter of the sheet of material. At least two opposing sides of the sheet each include at least one crease respectively. The sheet is folded along at least a first crease thereby creating a first portion and a second portion. The first portion of the sheet protects a first surface and the second portion of the sheet protects a second surface. The first surface is generally orthogonal to the second surface; however, this is not required (e.g., 5-150°). Generally the one or more creases are located on either the top or bottom surface; however, the one or more creases can be located on both surfaces of the fiberboard. Each the crease generally includes a respective offset from a side of the sheet that is different from another crease; however, this is not required. In one non-limiting arrangement, at least two of the creases are proximal to one side of the perimeter of the sheet and offset at different positions relative to one side. One or more of the creases can be perforated and/or water resistant; however, this is not required. The fiberboard can optionally be a constructed of a water resistant material.

The invention is also directed to a method of forming the surface protector. The method can include the steps of a) providing a fiberboard sheet having a perimeter, b) scoring the fiberboard sheet to include one or more creases aligned generally parallel to at least one sides of the sheet, c) positioning the crease to be offset from the perimeter. When two or more creases are formed, the two creases can be positioned to be offset from the perimeter of the sheet at a different location; however, this is not required. The created sheet can be folded along at least a first crease thereby creating a first portion and a second portion of the sheet on either side of the first crease; wherein the first portion of the sheet protects a first surface and the second portion of the sheet protects a second surface. A creasing wheel that is used to form the one or more creases in the fiberboard is generally made of a durable material (e.g., metal, rubber, wood, hard plastic, resin material, etc.) is used for perforating the fiberboard sheet and/or for scoring of the plurality of creases. The creasing wheel has been found to make the desired crease on the fiberboard. It is believed that the wheel allows for precision and adjustability in applying the crease marks. As can be appreciated, the wheel can have a force applied to the wheel by various arrangements (e.g., pneumatic pressure, mechanical spring, gas spring, weight, etc.). The scoring in the fiberboard includes a depth from about 5% to about 30% of a depth of the fiberboard sheet, typically about 10% to 20% of a depth of the fiberboard sheet. In one non-limiting arrangement, the scoring in the fiberboard includes a depth from about 14.5%. Generally, the depth of the crease is constant along the length of the crease; however, this is not required. If the crease mark is not of the desired depth, then the fiberboard is prone to rip, splinter, and/or check along the folded crease, thereby damaging the integrity of the fiberboard and the resistant properties of the fiberboard. The pressure that is applied by the wheel to the fiberboard is selected to form a clean crease that is visible to the eye, yet does not damage the integrity of the fiberboard. If the crease is too shallow, then it becomes difficult to see the crease line in the fiberboard. Also, if the crease is too shallow, then the fiberboard does not easily fold along the crease mark. If the crease is too deep, the fiberboard will rip and tear when attempting to fold along the crease. As such, if the crease is not of the correct depth, then it can cause the fiberboard to rip, splinter, and/or check along the fold, thereby damaging the integrity of the fiberboard and any liquid resistant properties of the fiberboard.

The wheel generally applies a pressure to the surface of the fiberboard of about 20 psi to 80 psi, typically about 30 psi to about 60 psi, and more typically about 40 psi to about 50 psi. Using pneumatic powered creasing wheels can be used to form a crease having a variable thickness and/or depth along one or more portions of the crease. The use of pneumatic powered creasing wheels can be used to form a crease having a generally constant width and/or thickness even though the fiberboard has a variable thickness. As can be appreciated, mechanical spring, gas spring, and/or weighted creasing wheels can be used to obtain such crease features. In one non-limiting arrangement, the wheel generally applies a pressure to the surface of the fiberboard of about 45 psi. The width of the one or more creases is generally about ⅛ inch to ⅝ inch, and typically about ¼ inch to about ½ inch. In one non-limiting arrangement, the width of the one or more creases is generally about ⅜ inch. The size and shape of the one or more wheels is non-limiting. The one or more wheels can have a smooth surface that contacts the fiberboard, a non-smooth surface (e.g., wheel having one or more teeth, recesses, etc.).

The creases are generally positioned 4 to 18 inches from the perimeter of the fiberboard. When a crease is formed generally parallel to the top of the fiberboard, the crease is generally spaced about 2 to 14 inches from the top of the fiberboard, typically 4 to 12 inches, more typically about 6 to 10 inches, and still more typically 7 to 9 inches. When a crease is formed generally parallel to the bottom of the fiberboard, the crease is generally spaced about 2 to 18 includes from the bottom of the fiberboard, typically 6 to 18 inches, more typically about 10 to 14 inches, and still more typically 11 to 13 inches. When a crease is formed generally parallel to one or more sides of the fiberboard, the crease is generally spaced about 1 to 8 inches from the side of the fiberboard, typically 2 to 6 inches, and more typically about 3 to 5 inches. The one or more creases can be colored to facilitate in the visual location of the crease; however, this is not required.

In one non-limiting object of the present invention, there is provided a creased fiberboard that provides protection to floor and/or wall surfaces.

In another and/or alternative non-limiting object of the present invention, there is provided a method for forming a creased fiberboard that provides protection to floor and/or wall surfaces.

In still another and/or alternative non-limiting object of the present invention, there is provided a creased fiberboard that resists tearing or breaking along the crease when folded along the crease.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the invention may take in physical form and in certain parts and arrangement of parts wherein.

DETAILED DESCRIPTION OF THE NON-LIMITING EMBODIMENTS

Figure 1:
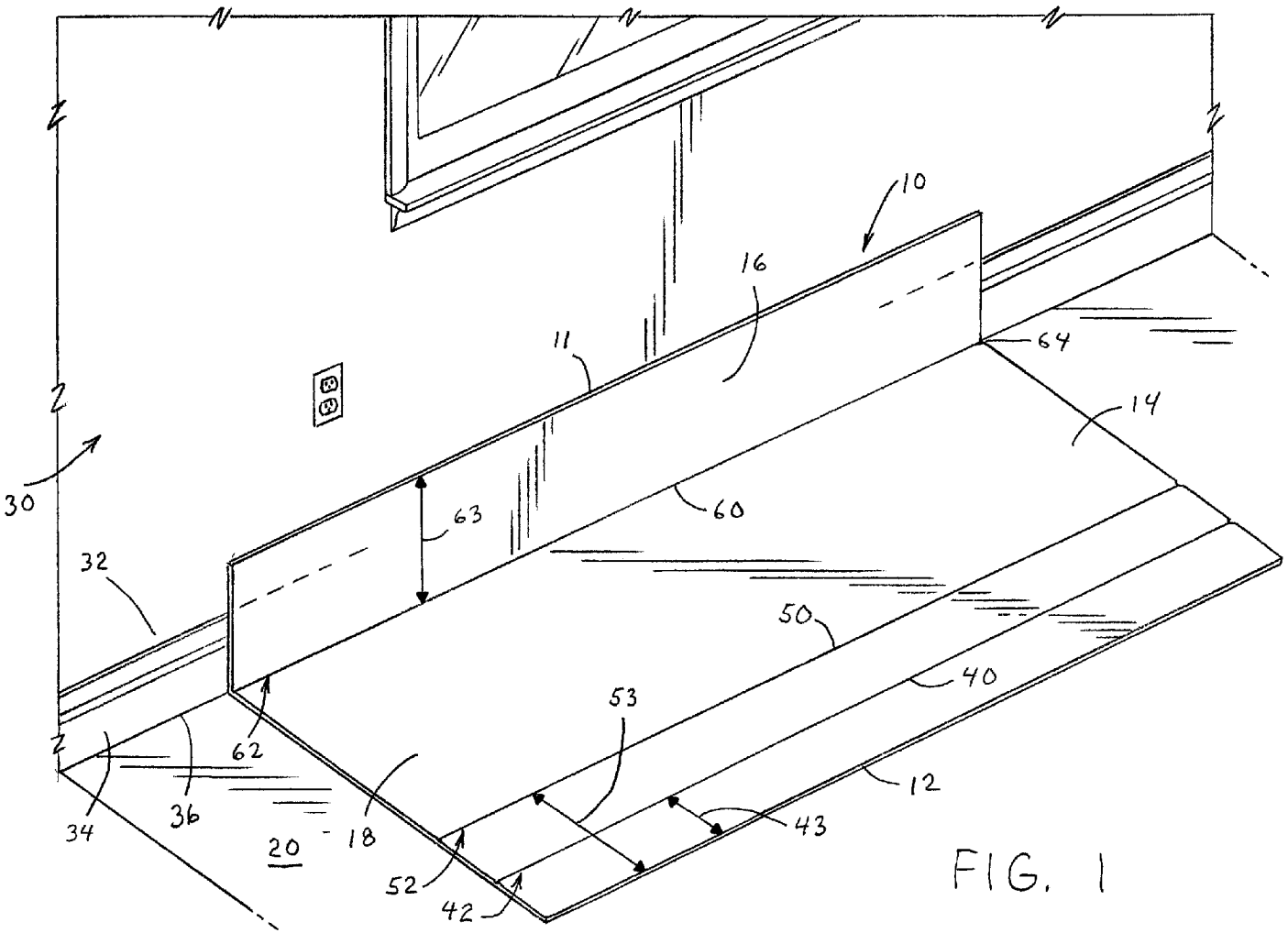
FIG. 1 is perspective view of the fiberboard surface protector in the use position.

Referring now to the drawings, wherein the showings are for the purpose of illustrating preferred embodiments of the invention only and not for the purpose of limiting same, the present disclosure provides for surface protection comprising easy folding water resistant fiberboard sheets or protectors 10 that allow for floor 20 and wall 30 protection, and/or countertop and wall protection, with one product. This eliminates the need for two separate products and extra steps in the protection process. It is to be appreciated that the device 10, to be described hereinafter, creates a seamless barrier between the floor/countertop 20 and wall 30.

It is to be appreciated that the lower section of walls 32, including the baseboard 34 can be easily damaged on job sites. Currently no product exists to easily protect job site floors 20 and walls 30 at the same time, and in particular, the junction 36 between the floor 20 and walls 30. Other products heretofore known are designed to protect floors or walls independently but not both at the same time with a single product. Prior art devices leave the base of walls 32, 34 and the perimeter of the junction 36 of floors 20 and walls 30 exposed to damage and susceptible to spillage/leakage. The present disclosure provides for a quick and easy folding of fiberboard to allow the floor 20 and wall 30 to be protected with a single product. The present device 10, to be described hereinafter in more detail, eliminates the need for two separate products and extra steps for the protection process. The device also creates a seamless barrier between the floor 20 and wall 30.

The fiberboard protector 10 (refer to FIGS. 1 and 2) provides for a temporary floor 20 and wall 33 protector that includes an embedded plurality of creases 40, 50, 60 manufactured along crease lines 42, 52, 62 that allow the fiberboard protector 10 to be easily folded in a straight alignment in at least three different places (i.e., positions) 42, 52, 62 in order to protect walls and floors simultaneously. As shown in FIG. 1, the fiberboard protector also creates a sealed perimeter 62 between the floor 20 and the wall 30.

Embedded creases 40, 50, 60 allow the fiberboard product to fold quickly and easily along the entire length of the crease 42, 52, 62. One or more of the separately defined crease lines 42, 52, 62 can be chosen for a fold line 64 based on a desired height of wall protection, for example 8" (FIG. 1). Folding along a predefined crease line 42, 52, 62 can give the fiberboard sheet 10 a clean orthogonal fold allowing for the floor 20 and wall 30 to be protected simultaneously in one product The fiberboard 10 can be creased (e.g., scored or perforated) using a rolling wheel 80 that passes over the fiberboard 10 for embedding the creases 40, 50, 60 therein (Refer to FIGS. 3 and 4). The rolling wheel 80 can be used to create at least three separate embedded crease lines 42, 52, 62 that are aligned and generally parallel with an entire length of at least one side edge 12 of the fiberboard sheet 10.

Figure 3:
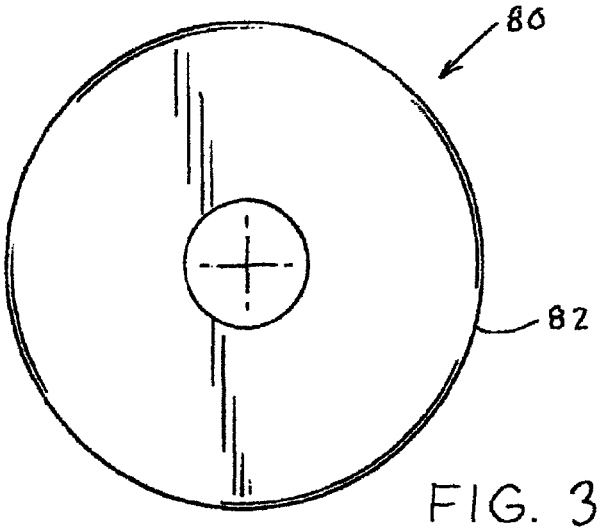
FIG. 3 is a front elevational view of a creasing wheel.
Figure 4:
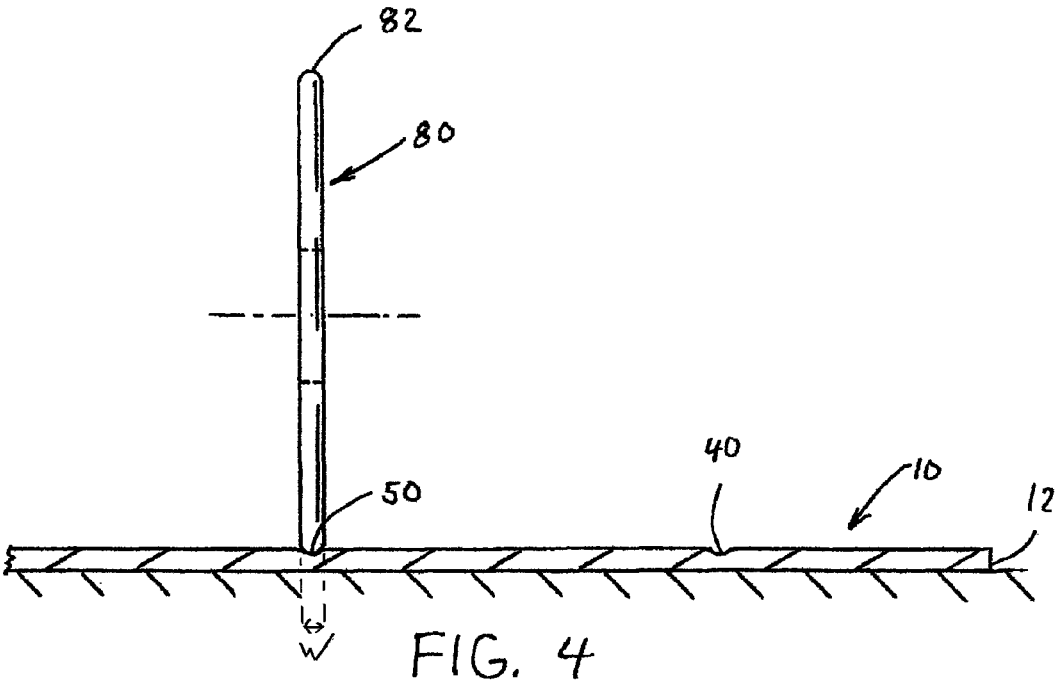
FIG. 4 is a side elevational view of the creasing wheel for scoring the fiberboard.

The rolling wheel 80 shown in FIGS. 3 and 4 comprises an exemplary creasing wheel 80 that can be used in one mounting arrangement such that a plurality of creasing wheels (not shown) separately embed crease lines 42, 52, 62 along an entire length of one or more faces 14 of the fiberboard 10. The creasing wheels provide a proper profile along an edge 82 for creating the embedded creases 40, 50, 60 at a desired orientation. Improper creasing can cause the fiberboard sheet 10 to tear excessively or prevent the creasing of the fiberboard sheet 10 along a straight line 42, 52, 62. Pressure on the creasing wheels should be at a high enough setting to crease the fiberboard sheet 10 to a proper depth. Pressure should also be uniform such that all of the creases 40, 50, 60 have a substantially equal depth.

Figure 2:
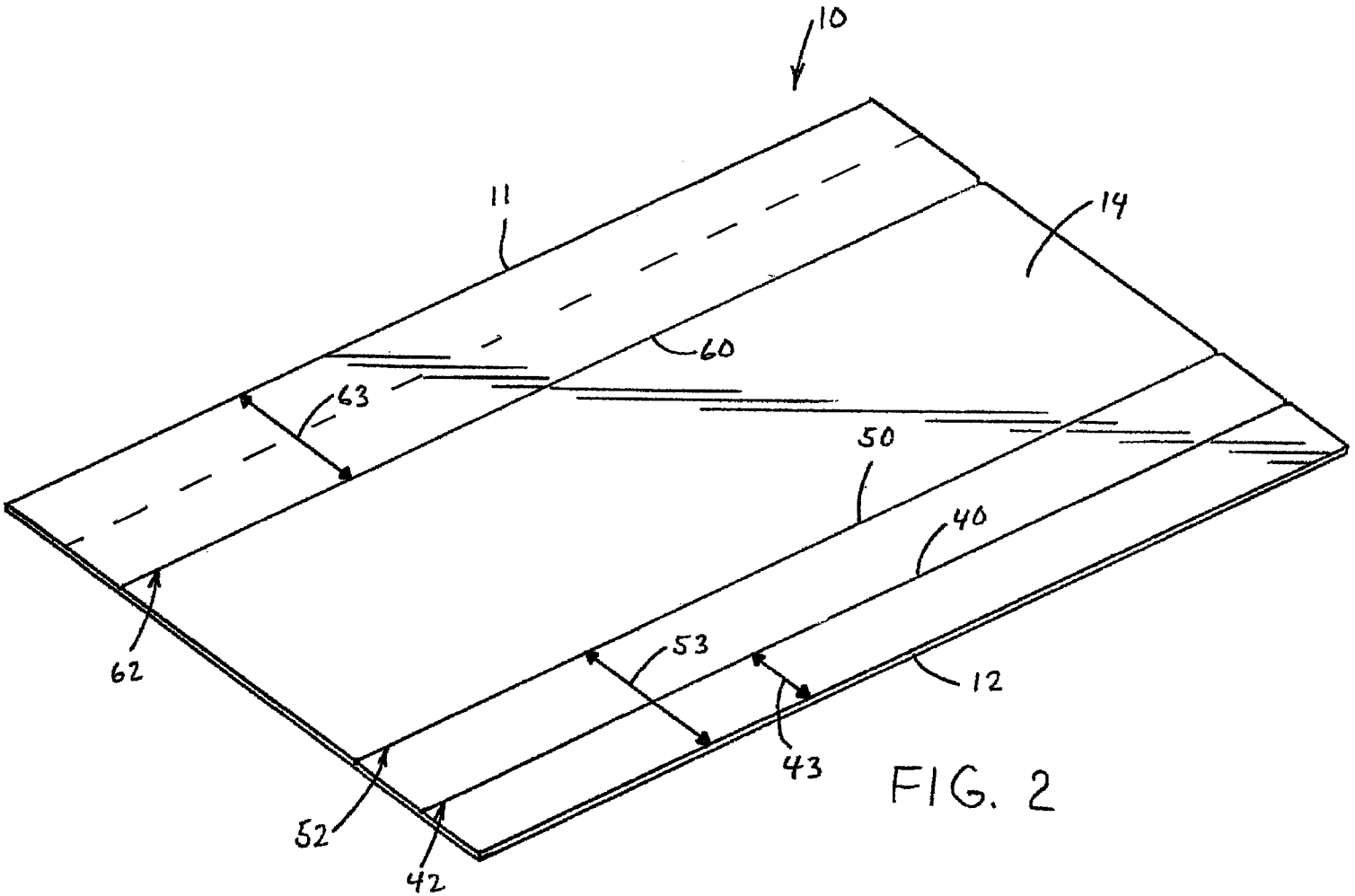
FIG. 2 is an elevational view of the fiberboard surface protector.

The fiberboard sheet 10 can be run through a series or a plurality of creasing rollers 80 that have been machined to the desired profile 82. The rollers 80 can then be applied to the fiberboard sheet 10 with a desired amount of air pressure to create the creases 40, 50, 60 with a specific depth and width that will allow the fiberboard to fold easily with minimal tearing to the surface of the fiberboard. Along the driven path can be a pneumatically activated set of creasing rollers applying pressure to the rollers thereby creating an aligned series of creases along one or more entire lengths (or substantially the entire lengths) of the sides of the fiberboard. It is to be appreciated that the creases 40, 50, 60 can comprise the creased lines 42, 52, 62. Pneumatic powered creasing wheels 80 can be used for applying the proper pressure. However, it can be appreciated that the creasing wheels do not need to be pneumatically powered. The pneumatic powered wheels can be used to enable precision and adjustability with respect to the application of the air pressure to the creasing wheels. The use of pneumatic powered wheels also allows for the natural variability of the thickness of the fiberboard to not affect the depth of the crease mark. In one exemplary arrangement the pneumatic powered wheels are metal wheels which provide for malleability, durability, cost control, and consistency. It is to be appreciated that the creasing wheels can also be made from rubber, plastic, wood, ceramic, and/or air. It is to be further appreciated that any number of crease lines can be embedded into the fiberboard sheet 10. In one exemplary arrangement the number of crease lines ranged between 1 and 10 crease lines. In another exemplary arrangement the number of crease lines ranged between 2 and 5 crease lines. In still a third exemplary arrangement the number of crease lines included 3 crease lines 42, 52, 62 (FIGS. 1 and 2). The number of creases can vary due to the customer needs and the particular application. Typically, a multitude of crease lines provide for the desired variability and flexibility needed to fold the fiberboard sheet 10 at a plurality of different spacings in order to provide the proper protection of a junction between a horizontal 20 and vertical 30 surface.

The depth of the creases 40, 50, 60 can be in the range from about 5% to about 30% relative to the thickness of the fiberboard sheet 10 (Refer to FIG. 4). In one exemplary arrangement the depth of the creases was from about 10% to about 20% relative to the thickness of the fiberboard sheet 10. In yet still another arrangement the depth of the creases was from about 13% to about 16% relative to the thickness of the fiberboard sheet 10. It is important to form the creases 40, 50, 60 at the desired depth in order to prevent the fiberboard sheet 10 from ripping, splintering, and/or checking along the subsequent fold line 64 which damages the integrity of the fiberboard sheet 10 and diminishes the liquid resistant properties that exist along the creases 40, 50, 60 and fold lines. The creasing wheels 80 and the air pressure applied thereto are processed at a consistent pressure in order to maintain the desired depths of the creased lines 42, 52, 62 in the fiberboard sheet 10.

The width W of the creases 40, 50, 60 also impacts functionality for proper folding of the fiberboard sheet 10. In one exemplary arrangement the width of the creases 40, 50, 60 was from about ⅛ inch to about ⅝ inch wide. In another exemplary arrangement the width of the creases 40, 50, 60 was from about ¼ inch to about ½ inch wide. The actual width of the creases provides for the proper functionality of the folds along the crease lines 42, 52, 62 in order to maintain the integrity of the fiberboard sheet 10. Creases that are too wide will not result in a straight fold line along a creased line, but rather create a too wide crease that wavers in a non-linear arrangement. If the crease line is not wide enough then the fiberboard sheet 10 will generally not fold smoothly and may cause ripping, splintering, and/or checking along the fold line on the backside of the fiberboard sheet which ultimately can damage the integrity of the fiberboard sheet 10 and diminish the liquid resistant properties that exist in the fiberboard sheet 10 and along the associated crease lines 42, 52, 62.

The air pressure (not shown) used for driving the pneumatic powered wheels 80 can be in the range of from about 20 psi to about 80 psi (for example). In another exemplary arrangement the psi for the pneumatic powered wheels 80 can be from about 40 psi to about 50 psi. The pressure applied to the pneumatic powered wheels affects the depth of the creased lines 42, 52, 62 in the fiberboard sheet 10. If the creased line is too shallow, the fiberboard sheet 10 will not easily fold along the creased line. If the creased line is too deep, the fiberboard sheet 10 will rip and tear when attempting to fold.

Placement and positioning of the plurality of crease lines 42, 52, 62 can include a series of parallel crease lines relative to the sides of the fiberboard sheet 10. In one exemplary arrangement, the first crease line 62 is positioned 63 from about 4 inches to about 12 inches from a first side 11 of the fiberboard sheet 10. The second crease line 42 can be positioned 43 from about 1 inch to about 6 inches away from a second side 12 of the fiberboard sheet 10. Still further, the third crease line 52 can be positioned 53 from about 7 inches to about 18 inches away from the second side 12 of the fiberboard sheet. FIGS. 1 and 2 demonstrate a fiberboard sheet 10 with three crease lines 42, 52, 62. As described above, it is to be appreciated that another arrangement can include four crease lines wherein an additional creased line is positioned from about 4 inches to about 12 inches away from a center line of the fiberboard sheet as illustrated by the dashed line in FIG. 2.

Any number of plurality of crease lines can be positioned along the fiberboard sheet such that the crease lines generally are aligned with, and offset from, a side(s) of the fiberboard sheet. The different spacings and positioning of the creased lines relative to a side(s) of the fiberboard sheet provides for custom folding to ensure adequate protection for the needed heights of wall baseboards, wall panels, backsplashes of counters, and top/front of counters, etc. It is to be appreciated that any number of fiberboard sheets can be utilized in conjunction with one another wherein respective outside crease lines are folded upward thereby creating a contained walkway with two upwardly extending side portions and two horizontally extending bottom portions. Also when two fiberboard sheets are used in tandem, they can be positioned to completely cover a floor surface, for example, and also cover partway up at least two vertical walls extending from the floor surface.

Referring again to FIG. 1, in use, the fiberboard sheet 10 can be rolled out to a desired length to protect the floor 20 and a section of the wall 32, 34 extending upward therefrom. The fiberboard sheet 10 can be cut to any desired length. A selected crease line 62 is then chosen to provide for the proper protection along a portion of the wall 32, 34 which extends orthogonally to the floor 20 below. The height 63 of the vertically extending portion 16 is based on the desired height of protection needed. The fiberboard sheet 10 with a portion 16 extending vertically and a portion 18 extending horizontally relative to a crease line 62 can be positioned such that the fold 64 is placed at the junction 36 of the floor 20 and the wall 30. The fiberboard sheet 10 will then cover the floor 20 and a portion 32, 34 of the vertically extending wall 30 simultaneously while creating a seamless barrier of protection at the fold 64. It is to be appreciated that a pair of fiberboard sheets used side-by-side will create a pathway with vertically folded portions that can contain dirt, debris, and liquid containments therebetween.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of making a surface protector to protect selected portions of at least two adjacent surfaces, the method comprising:

providing a fiberboard sheet of foldable material having a perimeter;

scoring a top surface of said fiberboard sheet to include a plurality of creases aligned generally parallel to at least two sides of said sheet, said step of scoring performed by a device applying up to 80 psi of pressure to said top surface of said fiberboard to form each of said creases;

positioning each said crease offset from said side at a different location than another said crease, each of said creases having a constant width and depth along a length of said crease;

wherein said creases are water resistant;

folding said sheet along at least a first crease thereby creating a first portion and a second portion of said sheet on either side of said first crease;

wherein said first portion of said sheet protects a first surface and said second portion of said sheet protects a second surface; and, wherein said first surface is generally orthogonal to said second surface.

2. The method as defined in claim 1, further comprising:

using a metal pneumatic powered wheel for perforating said fiberboard sheet for said scoring of said plurality of creases.

3. The method as defined in claim 1, further comprising:

using a pneumatic powered wheel for scoring said fiberboard sheet including said plurality of creases.

4. The method as defined in claim 1, wherein said scoring includes a depth from about 10% to about 20% of a depth of said fiberboard sheet.

5. The method as defined in claim 3, wherein said pneumatic powered wheel includes a pressure from about 40 psi to about 50 psi.

6. The method as defined in claim 1, wherein said creases include a width from about ¼ inch to about ½ inch.

7. The method as defined in claim 1, wherein said plurality of creases includes three (3) creases;

a first crease is aligned with a first side of said sheet and offset at a distance from about 4 inches to about 12 inches;

a second crease is aligned with a second side of said sheet and offset at a distance from about 1 inch to about 6 inches; and, a third crease is aligned with said second side of said sheet and offset at a distance from about 7 inches to about 18 inches.

8. The method as defined in claim 1, wherein said plurality of creases includes four (4) creases;

a first crease is positioned from about 4 inches to about 12 inches from a first side of said sheet;

a second crease is positioned from about 4 inches to about 12 inches from a center line of said sheet;

a third crease is positioned from about 1 inch to about 6 inches from a second side of said sheet; and, a fourth crease is positioned from about 7 inches to about 18 inches from said second side of said sheet.

9. A method of making a floor surface protector to protect selected portions of at least two adjacent surfaces of a floor surface, the method comprising:

providing a fiberboard sheet of foldable material having a perimeter, said fiberboard constructed of a water resistant material;

scoring only a top surface of said fiberboard sheet to include a plurality of creases aligned generally parallel to at least two sides of said fiberboard sheet, each of said creases in said fiberboard sheet has a depth of about 5% to about 30% of a depth of said fiberboard sheet, said depth of each of said creases is constant along a length of said crease, each of said creases includes a width of about ¼ inch to about ½ inch, each of said creases having a constant width along a length of said crease, said step of scoring including using a wheel for forming said scoring on said fiberboard sheet, said wheel applying 20 psi to 80 psi of pressure to said top surface of said fiberboard to form each said creases;

positioning each said crease offset from said side at a different location than another said crease;

wherein said creases are water resistant;

folding said fiberboard sheet along at least a first crease thereby creating a first portion and a second portion of said sheet on either side of said first crease, said crease configured such that during said folding step said crease does not tear or separate and maintains its water resistance;

placing said folded fiberboard sheet on said floor surface;

wherein said first portion of said sheet protects a first surface of said floor and said second portion of said sheet protects a second surface of said floor; and, wherein said first surface is generally orthogonal to said second surface.

10. The method as defined in claim 9, wherein said wheel applies a pressure of about 40 psi to about 50 psi to said top surface of said fiberboard sheet to form said creases.

11. The method as defined in claim 10, wherein said plurality of creases includes three (3) creases;

a first crease is aligned with a first side of said sheet and offset at a distance from about 4 inches to about 12 inches;

a second crease is aligned with a second side of said sheet and offset at a distance from about 1 inch to about 6 inches; and, a third crease is aligned with said second side of said sheet and offset at a distance from about 7 inches to about 18 inches.

12. The method as defined in claim 11, wherein said wheel is a pneumatic powered wheel.

13. The method as defined in claim 10, wherein said plurality of creases includes four (4) creases;

a first crease is positioned from about 4 inches to about 12 inches from a first side of said sheet;

a second crease is positioned from about 4 inches to about 12 inches from a center line of said sheet;

a third crease is positioned from about 1 inch to about 6 inches from a second side of said sheet; and, a fourth crease is positioned from about 7 inches to about 18 inches from said second side of said sheet.

14. The method as defined in claim 13, wherein said wheel is a pneumatic powered wheel.

* * * * *